United States Patent [19]

DuBois et al.

[11] 4,196,227

[45] Apr. 1, 1980

[54] METHOD OF FORMING CARBON ANODES IN MULTIDIGIT FLUORESCENT DISPLAY DEVICES

[75] Inventors: Richard DuBois, North Caldwell; Donald M. Ashton, Jr., Glen Ridge, both of N.J.

[73] Assignee: Wagner Electric Corporation, Parsippany, N.J.

[21] Appl. No.: 898,305

[22] Filed: Apr. 20, 1978

[51] Int. Cl.[2] ..... B05D 5/06

[52] U.S. Cl. ..... 427/67; 427/64; 427/122; 427/282; 313/496; 252/506; 252/510

[58] Field of Search ..... 427/64, 122, 282, 67; 252/506, 510; 313/496

[56] References Cited

U.S. PATENT DOCUMENTS

| | | | |
|---|---|---|---|
| 2,151,992 | 3/1939 | Schwartz | 427/122 |
| 2,818,355 | 12/1957 | Hesemans | 427/122 |
| 3,518,116 | 6/1970 | Stock | 252/506 |
| 3,532,640 | 10/1970 | Scharrer | 252/506 |
| 3,906,269 | 9/1975 | Tanji | 313/483 |
| 4,035,265 | 7/1977 | Saunders | 252/510 |
| 4,041,347 | 8/1977 | Deal | 427/64 |
| 4,085,235 | 4/1978 | Compen | 427/122 |

*Primary Examiner*—Michael F. Esposito

*Attorney, Agent, or Firm*—Eyre, Mann, Lucas & Just

[57] ABSTRACT

Finely divided carbon in emulsion in an organic silicate is silk screened onto a substrate to form conductive elements for a fluorescent display device which, when baked, provides a willing host surface upon which a phosphor coating is applied. In one embodiment of the invention, a metallic oxide is mixed with the finely divided carbon.

10 Claims, No Drawings

METHOD OF FORMING CARBON ANODES IN MULTIDIGIT FLUORESCENT DISPLAY DEVICES

BACKGROUND OF THE INVENTION

In the manufacture of conductive electrodes on the substrate of a fluoroescent display device, it has been shown to be advantageous to use an electrode formed of or coated with finely divided carbon bound in an inert matrix. U.S. Pat. No. 3,906,269, incorporated herein by reference, describes the advantages of using carbon in this application.

In the prior art cited above, water glass is used as an inorganic binder for the finely divided carbon. Water glass permits the carbon particles to bond well to each other and to metallic elements and insulating substrates such as ceramic or glass and, when baked, forms an inert matrix permanently binding the carbon particles in place without excessively insulating the particles one from the other. Consequently, a conductive element is provided.

A carbon and water glass mixture has been customarily applied by painting, spraying, flowing on, by doctor blade or from a slurry. After application, the water glass and carbon mixture is baked to set the water glass and permanently fix the carbon in the matrix formed by the water glass. None of these methods of application is entirely satisfactory for volume production of electrodes on substrates. Better control of the shape of the electrodes and higher throughputs are desired to maintain adequate production rates.

Silk screening is a satisfactory process from an accuracy and speed standpoint and it was the desired method for making carbon electrodes. However, the properties of water glass are such that it is difficult, if not impossible, to obtain even a single satisfactory electrode pattern on the substrate, let alone a plurality of applicants which is, of course, the advantage of silk screening. Upon attempts to silk screen a pattern of water glass and carbon mixture onto a substrate, the mixture immediately hardened in the silk screen and completely blocked the interstices of the screen and was impossible to remove. No acceptable substitute for water glass in this application has previously been known.

DETAILED DESCRIPTION OF THE INVENTION

The applicant has discovered a method of rapidly and accurately forming carbon electrodes by silk screening which permits thousands of uses of the silk screen.

An emulsion of from about 1 to about 33 and preferably from about 5.3 to 18 parts of an organic silicate preferably an alkyl silicate and for best results most preferably ethyl silicate to 100 parts of finely divided carbon permits adequate bonding of the carbon particles to each other and to an insulating substrate or a metallic electrode and further permits the use of a silk screen for thousands of applications without having to replace the silk screen. The carbon used may be of the type manufactured by the Joseph Dixon Crucible Co., Jersey City, N.J. and identified as Dixon Airspun Graphite Type 200-09. Although the invention is not limited to carbon powder particle size, carbon powder having a particle size of from about 2 to about 20 micrometers and most suitably about 5 micrometers are preferred. The ethyl silicate is suitably tetraethyl orthosilicate $(C_2H_5O)_4Si$, and may be of the type manufactured by Union Carbide and identified in Chemical Abstracts Registry No. 78-10-4.

In a second embodiment of the invention, the finely divided carbon in the emulsion is replaced with a mixture of finely divided alumina and finely divided carbon. The use of alumina, $Al_2O_3$, increases the brightness of the glow of the phosphor in the finished fluorescent display device. The alumina should comprise from about 1 to about 45 and preferably from about 5 to about 15 percent of the alumina-carbon mixture with best results being obtained at about 10 percent. In proportions of alumina greater than about 45 percent the conductivity of the electrode becomes excessively degraded. At extremely low percentages of alumina, no noticeable improvement in brightness is observed.

Other metallic oxides which improves display brightness may be substituted for the alumina without departing from the scope of the invention. For example beryllia can be used; however it is not preferred because of the extreme toxicity of that material.

Two problems are sought to be solved by the present invention, that is, binding of finely divided carbon into a matrix and to an insulating substrate or metallic element and providing a willing host surface for a phosphor to be overlaid upon the carbon electrode. The applicant has discovered that the surface texture and other properties of a carbon electrode formed in a matrix of ethyl silicate provides a willing host to a phosphor material such as ZnO:Zn. Other phosphors which may be used are described in U.S. Pat. No. 3,986,760 herein incorporated by reference and may include at least ZnS and SnO:Eu.

After application of the carbon in ethyl silicate, the ethyl silicate is set by baking at typical temperatures of between 250° to 500° C. This produces an inert matrix binding the finely divided carbon particles together and to the substrate. After the baking process, a phosphor material of any type well known in the art may be applied also by silk screening or other means to the surface of the carbon electrodes.

EXAMPLE

Tetraethyl orthosilicate was prepared by mixing 114 ml of tetraethyl orthosilicate with 72 ml of ethanol and 14 ml of 1 percent hydrochloric acid. The mixture was allowed to stand for 24 hours at room temperature and yielded a colloidal suspension. The colloidal suspension was mixed with carbon powder, ethyl cellulose and ethanol in the proportions of 11.50 percent coloidal suspension, 44.25 percent carbon powder, 33.19 percent ethyl cellulose, and 11.06 percent dibutyl phthalate. The solvents were evaporated by heating at 150° C. for ½ hours to yield a viscous material ready for screening. The viscous material was screened on a glass substrate and baked at 450° C. for 30 minutes.

It will be understood that the claims are intended to cover all changes and modifications of the preferred embodiments of the invention, herein chosen for the purpose of illustration which do not constitute departures from the spirit and scope of the invention.

What is claimed is:

1. A process for forming an electrode pattern in a fluorescent display device of the type wherein said electrode pattern is deposited on a substrate, wherein the improvement comprises:

(a) mixing from about 1 to about 33 parts of organic silicate with 100 parts of finely divided carbon to form an emulsion;

(b) silk screening said emulsion onto said substrate; and (c) baking said emulsion.

2. The process recited in claim 1 further comprising said organic silicate being an alkyl silicate and being present in an amount of from about 5.3 to about 18 parts per 100 parts of carbon.

3. The process recited in claim 1 wherein said organic silicate is ethyl silicate.

4. The process recited in claim 3 wherein said ethyl silicate is tetraethyl orthosilicate.

5. The process recited in claim 1 further comprising coating at least part of the baked emulsion with phosphor.

6. A process for forming an electrode pattern in a fluorescent display device of the type wherein said electrode pattern is deposited on a substrate, wherein the improvement comprises:

(a) mixing from about 1 to about 45 percent alumina with finely divided carbon to form a mixture;

(b) mixing from about 1 to about 33 parts of organic silicate with 100 parts of said mixture to form an emulsion;

(c) silk screening said emulsion onto said substrate forming at least part of said electrode pattern; and (d) baking said emulsion.

7. The process recited in claim 6 further comprising coating at least part of the baked emulsion with phosphor.

8. The process recited in claim 6 wherein the step of baking is performed at between 250° and 500°C.

9. The process recited in claim 6 wherein said organic silicate is ethyl silicate.

10. The process recited in claim 9 wherein said ethyl silicate is tetraethyl orthosilicate.

* * * * *